US007143920B2

(12) United States Patent
Panasik et al.

(10) Patent No.: US 7,143,920 B2
(45) Date of Patent: Dec. 5, 2006

(54) PRIMARY AND SECONDARY HANDLES FOR POWER TOOL

(75) Inventors: Cheryl L. Panasik, Elburn, IL (US); Kevin M. Tucker, Chicago, IL (US); James W. Robinson, Mundelein, IL (US); Yongping Gong, Glenview, IL (US); Norbert K. Kolodziej, Park Ridge, IL (US)

(73) Assignee: Illinois Tool Works Inc., Glenview, IL (US)

( * ) Notice: Subject to any disclaimer, the term of this patent is extended or adjusted under 35 U.S.C. 154(b) by 13 days.

(21) Appl. No.: 10/931,632

(22) Filed: Sep. 1, 2004

(65) Prior Publication Data

US 2006/0043141 A1 Mar. 2, 2006

(51) Int. Cl.
*B25C 1/08* (2006.01)
*B27F 7/09* (2006.01)

(52) U.S. Cl. ..... 227/120; 227/9; 227/130; 227/156

(58) Field of Classification Search ..... 227/127, 227/128, 9, 10, 110, 120, 130, 135, 136, 137, 227/156; D8/67, 68, 69
See application file for complete search history.

(56) References Cited

U.S. PATENT DOCUMENTS

| | | | | | |
|---|---|---|---|---|---|
| 1,357,208 | A | * | 10/1920 | Payne | 42/75.01 |
| 3,973,179 | A | * | 8/1976 | Weber et al. | 320/113 |
| 4,197,974 | A | * | 4/1980 | Morton et al. | 227/8 |
| 4,483,474 | A | * | 11/1984 | Nikolich | 227/8 |
| D326,805 | S | * | 6/1992 | Clivio | D8/69 |
| 5,484,094 | A | * | 1/1996 | Gupta | 227/8 |
| 5,558,264 | A | | 9/1996 | Weinstein | |
| D383,656 | S | * | 9/1997 | Muro | D8/68 |
| D387,260 | S | * | 12/1997 | Hattori | D8/69 |
| 5,772,096 | A | * | 6/1998 | Osuka et al. | 227/5 |
| 5,781,691 | A | * | 7/1998 | Kwok | 392/405 |
| D396,789 | S | * | 8/1998 | Murray | D8/68 |
| D408,250 | S | * | 4/1999 | Matsuoka et al. | D8/68 |
| D427,499 | S | * | 7/2000 | Ricci et al. | D8/68 |
| 6,102,270 | A | * | 8/2000 | Robinson | 227/10 |
| 6,123,241 | A | | 9/2000 | Walter et al. | |
| 6,223,966 | B1 | * | 5/2001 | Nayrac et al. | 227/130 |
| D474,386 | S | * | 5/2003 | Arai | D8/68 |
| D477,513 | S | * | 7/2003 | Bor | D8/68 |
| D479,110 | S | * | 9/2003 | Nolan et al. | D8/68 |
| D481,602 | S | * | 11/2003 | Hattori | D8/68 |
| 6,644,530 | B1 | * | 11/2003 | Chen | 227/109 |
| 6,672,404 | B1 | * | 1/2004 | Kamo et al. | 173/11 |
| 6,722,548 | B1 | * | 4/2004 | Odoni et al. | 227/8 |
| D491,035 | S | * | 6/2004 | Buck | D8/68 |

(Continued)

FOREIGN PATENT DOCUMENTS

DE 101 25 716 A1 12/2002

(Continued)

*Primary Examiner*—Stephen F. Gerrity
*Assistant Examiner*—Paul Durand
(74) *Attorney, Agent, or Firm*—Lisa M. Soltis; Mark W. Croll; Greer, Burns & Crain, Ltd.

(57) ABSTRACT

A housing for a power tool includes a primary handle configured for accommodating a primary hand used to control the operation of the tool, the handle having a first end closer to a power source of the tool, and a second end distal of the power source, a secondary handle configured for accommodating a secondary hand, being associated with the distal end and defining a distal extremity of the tool offsetting the power source.

16 Claims, 3 Drawing Sheets

U.S. PATENT DOCUMENTS

| | | | | |
|---|---|---|---|---|
| D502,377 | S * | 3/2005 | Aglassinger | D8/69 |
| D502,637 | S * | 3/2005 | Hattori et al. | D8/68 |
| 2002/0017548 | A1 | 2/2002 | Jalbert et al. | |
| 2003/0034377 | A1 | 2/2003 | Porth et al. | |
| 2003/0218042 | A1 | 11/2003 | Odoni et al. | |
| 2004/0056063 | A1 * | 3/2004 | Rosenbaum et al. | 227/10 |
| 2005/0092808 | A1 * | 5/2005 | Jakob et al. | 227/10 |
| 2005/0247749 | A1 * | 11/2005 | Wywialowski et al. | 227/120 |

FOREIGN PATENT DOCUMENTS

| | | | |
|---|---|---|---|
| EP | 0 251 684 | A1 | 1/1988 |
| EP | 0 936 031 | A1 | 8/1999 |

* cited by examiner

PRIMARY AND SECONDARY HANDLES FOR POWER TOOL

BACKGROUND

The present invention relates generally to handheld power tools, and specifically to combustion-powered fastener-driving tools, also referred to as combustion tools.

Handheld power tools, including but not limited to drills, saws and fastener drivers are provided in a variety of sizes, depending on the application. Often such tools intended for commercial use are provided with heavier, more durable components to withstand more severe operational environments. In some cases, making the tools more durable provides an unintended consequence, in that the tool becomes tiring to hold for extended periods of use. Tool weight is especially important when work is performed at chest height or overhead, such as in the installation of walls, ceilings or overhead utilities.

Combustion-powered tools are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein. Similar combustion-powered nail and staple driving tools are available commercially from ITW-Paslode of Vernon Hills, Ill. under the IMPULSE®, BUILDEX® and PASLODE® brands.

Such tools incorporate a housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. The engine includes a reciprocating piston with an elongated, rigid driver blade disposed within a single cylinder body.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original, or pre-firing position, through differential gas pressures within the cylinder. Fasteners are fed magazine-style into the nosepiece, where they are held in a properly positioned orientation for receiving the impact of the driver blade.

Conventional combustion fastener driving tools employ straight magazines holding approximately 75 fasteners each. In some operational applications, particularly commercial construction projects, there is a need for a tool which is capable of driving a greater number of fasteners in a shorter period of time. The use of coil magazines with greater fastener capacities is common in electrically or pneumatically powered fastener driving tools, but for various reasons, such magazines have not become acceptable with combustion tools. Reasons for the undesirability of such high capacity magazines in these tools include the additional weight of the fasteners causing premature operator fatigue, and the additional energy required to operate the coil magazine fastener advance has not proved reliable.

Aside from the size of the magazine of conventional combustion tools, the weight, balance and overall ergonomics of conventional tools have not been suitable for high volume commercial construction applications, among others. Often, when such tools are used for high firing rate installations, approaching or exceeding 100 fasteners per minute, tool ergonomics becomes important in maintaining operator satisfaction with the tool. In such applications, the operator holds the tool for driving fasteners into a vertical surface such as wallboard. As such, the longitudinal axis of the combustion engine is generally horizontal or generally parallel to the ground. Since the combustion engine is usually the heaviest component of the tool, it has a tendency to exert a counterforce to the operator's efforts to control the position of the tool against the workpiece. As a result, the tool tends to be top-heavy, which results in operator fatigue after extended use.

In some applications, operators find that opportunities arise for holding the tool with both hands. Such applications include, but are not limited to situations where the tool is held chest-high or overhead for extended periods of time. While auxiliary handles are well known for many types of power tools, they typically are provided in the form of stub-shafts which are fastened to the tool housing to project outwardly. In the case of combustion-powered fastener-driving tools, design factors of weight and balance are more critical, and conventional auxiliary handles have not been widely adopted.

Also, since balance of combustion-powered fastener-driving tools is important for operator satisfaction, and since the combustion engine is relatively heavy, designers have used the handle to locate other tool components such as electronic control modules, batteries and the like. Such placement offsets the imbalance caused by the combustion engine. However, tool imbalance remains an operational factor for the use of combustion-powered tools in commercial applications.

Another design factor related to combustion-powered fastener-driving tools is that tool and/or environmental temperature influences tool performance, including but not limited to the return of the piston to the prefiring position at the end of the firing/fastener-driving operational cycle. Piston return is accomplished through differential gas pressure within the tool's engine, and such gas pressures are influenced by ambient temperature, particularly in exceptionally hot or cold conditions.

An operational factor in the use of combustion-powered tools is that ambient temperature influences tool performance. At lower ambient temperatures, more fuel is needed to obtain desired combustion. However, conventional tools are incapable of adjustment to variations in ambient conditions.

Still another design factor of such tools is the tendency of conventional combustion tools used in commercial construction applications to jam due to close tolerances between the magazine, the nosepiece and the fasteners being fed from the magazine to the nosepiece. Frequent jams increase operator frustration with such tools.

Thus, there is a need for a power tool having a supplemental handle which does not impair the balance, or add significant weight to the tool. There is also a need for a supplemental handle for a combustion-powered tool which is suitable for incorporating tool components, including but not limited to electronics, batteries and/or temperature monitoring devices.

BRIEF SUMMARY

The above-listed needs are met or exceeded by the present handle for a power tool. The handle includes a main portion or primary handle configured- for accommodating the primary hand used to operate the trigger. A secondary or supplemental handle portion is configured to specifically accommodate the non-dominant hand and provides a connection point between a battery housing and a magazine. In a preferred embodiment, the secondary handle is independent of the battery housing and the magazine of the tool.

More specifically, a housing for a power tool includes a primary handle configured for accommodating a primary hand used to control the operation of the tool, the handle having a first end closer to a power source of the tool, and a second end distal of the power source, a secondary handle configured for accommodating a secondary hand, being associated with the distal end and defining a distal extremity of the tool offsetting the power source.

DETAILED DESCRIPTION

Figure 1:
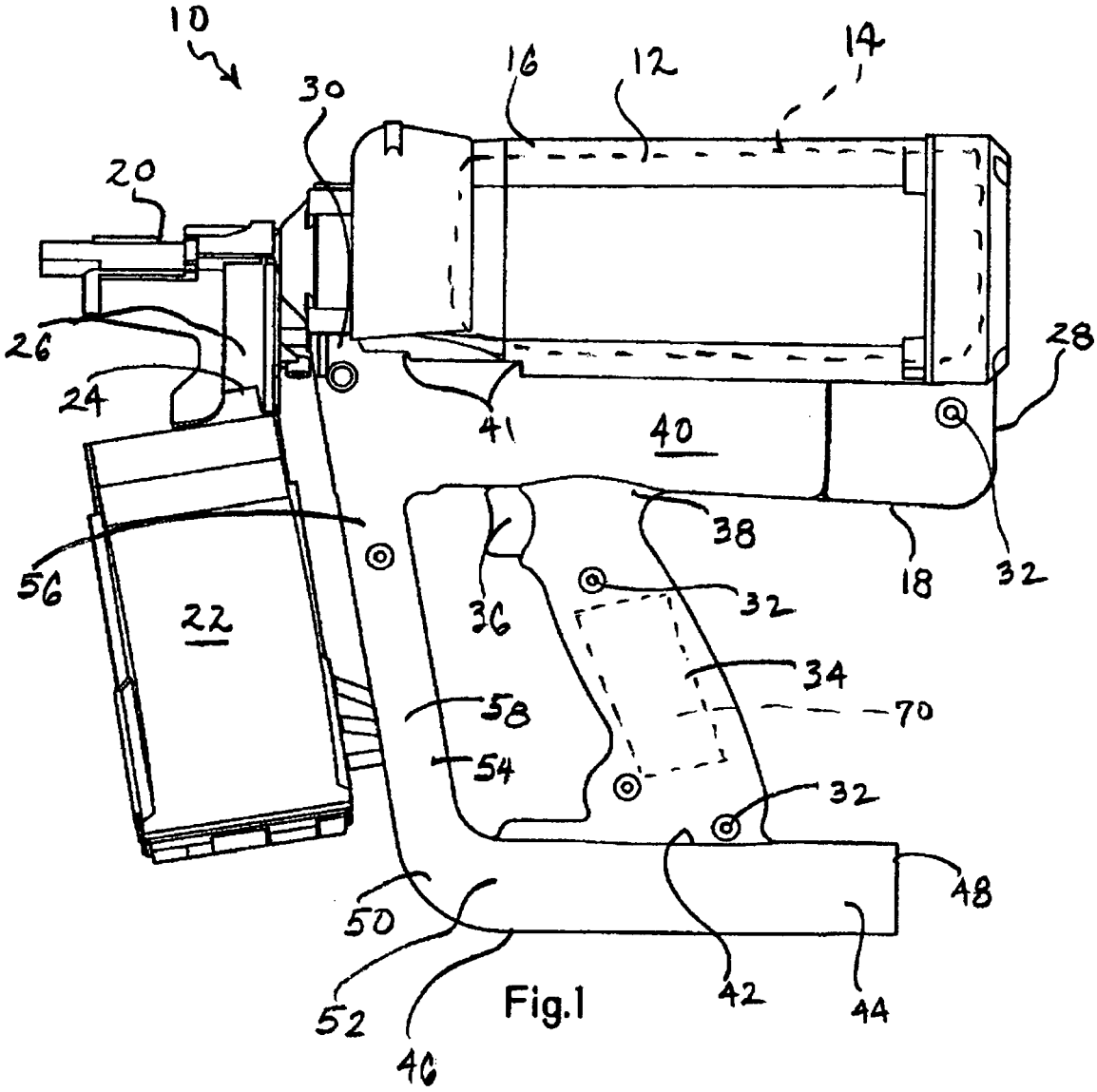
FIG. 1 is a side elevation of a combustion-powered fastener-driving tool incorporating the present handle housing.

Referring now to FIG. 1, a combustion-powered, fastener-driving tool suitable for incorporating the present handle housing is generally designated 10. While the tool 10 is depicted as being of the type described in the patents listed above, other types of fastener-driving tools are contemplated as having the potential of incorporation of the present handle housing. The tool 10 includes a main housing 12, usually injection molded plastic. In the present tool 10, a variation of the housing construction is that a power source 14 (preferably a combustion-powered power source as is known in the art and shown hidden) is enclosed by a power source housing 16, and a separate handle housing generally designated 18 is joined to the power source housing and to the tool.

Other major components of the tool 10 are a nosepiece assembly 20, which contacts the workpiece and through which fasteners (not shown) are driven, and a magazine 22 providing a supply of fasteners (not shown) and configured for feeding the fasteners to the nosepiece assembly. In the preferred embodiment, the magazine 22 is a coil-type, retaining a relatively large number of fasteners (at least 150) and the magazine advancement is powered by exhaust gases generated in the combustion process as described in U.S. Pat. No. 5,558,264, incorporated by reference. However, the present tool 10 is also contemplated as being used with straight, spring-advanced magazines having a reduced fastener capacity. The coil magazine 22 is configured for engagement with the nosepiece assembly 20 so that fasteners may be fed easily and with limited opportunity for becoming jammed in the delivery process. As such, a forward end 24 of the magazine 22 is slidingly engaged upon a receiving portion 26 of the nosepiece assembly 20.

Figure 2:
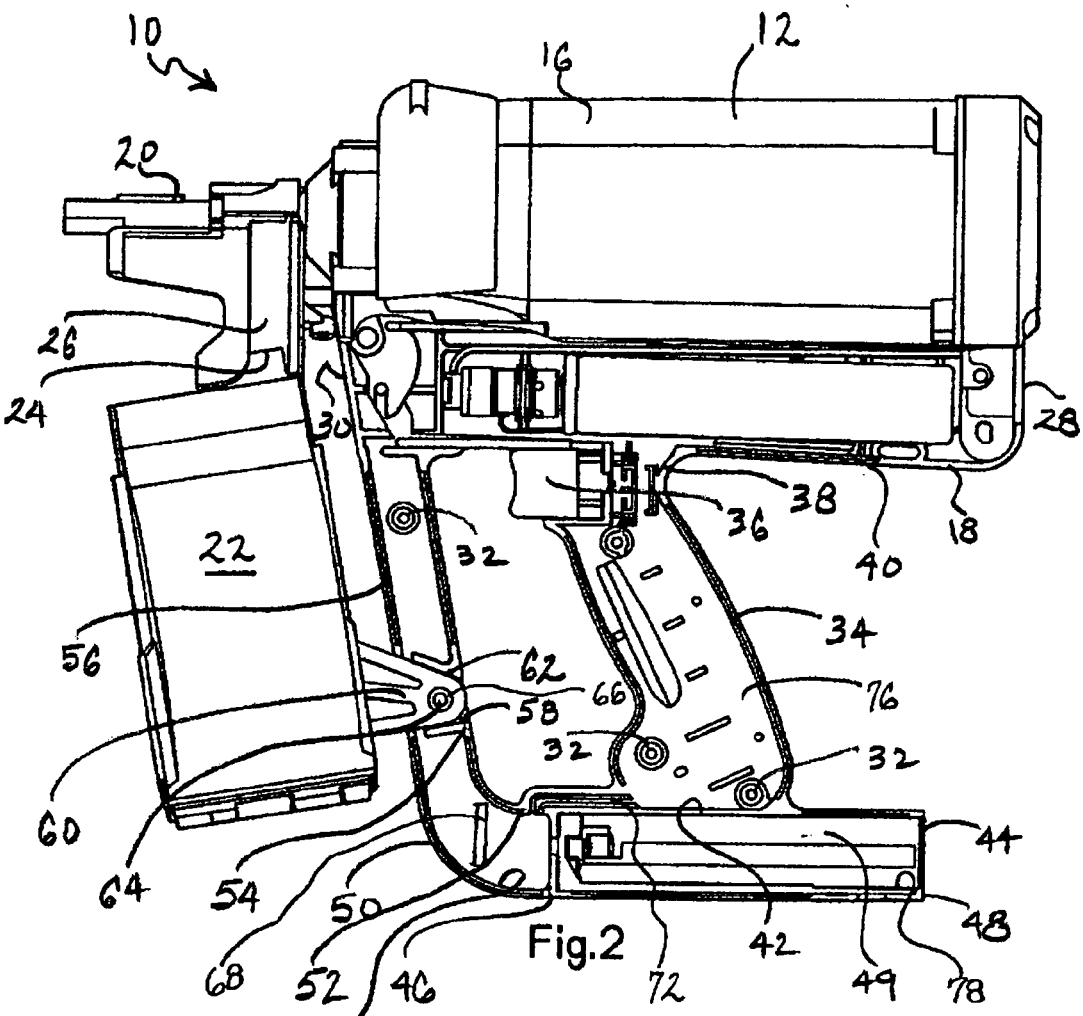
FIG. 2 is a side elevation of a combustion-powered fastener-driving tool incorporating the present handle housing, with portions shown cut away for clarity.

Referring now to FIGS. 1 and 2, the handle housing 18 is shown being secured along the power source housing 16 from a combustion end 28 to a nosepiece end 30. As is well known in the art, the handle housing 18 is provided in two halves joined along a vertical parting line and secured together with fasteners at several fastener points 32. FIG. 2 depicts the handle housing 18 with one such half removed. Included on the handle housing 18 is a primary handle 34 configured for accommodating a primary hand used to control the operation of the tool. The primary handle 34 incorporates a trigger switch 36 configured for initiating combustion and other tool functions as is well known in the art. A first end 38 of the primary handle 34, is closer to the power source 14, and is joined to a fuel cell chamber 40 which is directly connected to the tool 10 adjacent the power source housing 16. Depending on the application, the handle housing 18 may be directly fastened to the power source housing 16, or may be fastened to the tool 10 to tightly engage the power source housing. To facilitate this engagement with the power source housing 16, the fuel cell chamber 40 is preferably provided with conforming formations 41 (FIG. 1) which follow the outer contour of the power source housing at the point of contact. In the preferred embodiment, to improve tool balance, the primary handle 34 is located closer to the nosepiece end 30 than to the combustion end 28. This is a departure from conventional tools, in which the handle is equidistant from the two ends. It has been found that tool balance is significantly improved by moving the primary handle 34 closer to the nosepiece end 30, especially when the tool 10 is used for installation of walls, in which position the power source longitudinal axis is generally parallel to the ground, or in a generally horizontal position.

A second end 42 of the primary handle 34 is distal of the power source 14 relative to the first end 38. As is known in the art, the primary handle 34 is preferably ergonomically shaped for promoting comfort of the user's main tool controlling hand. In the preferred embodiment, a battery housing 44 is associated with, and preferably joined to the second end 42, and is oriented to be generally parallel to the longitudinal axis of the power source 14 and the fuel cell chamber 40. In addition, it will be seen that the second end 42 is joined to the battery housing 44 closer to a nosepiece end 46 of that housing than to a combustion end 48 of that housing. Thus, when equipped with a battery 49 (FIG. 2), and with the movement of the primary handle 34 as described above, the battery housing 44 contributes to the counterbalancing of the normally inherently nosepiece-heavy condition of such tools. Accordingly, the tool 10 is more equally balanced when held in an operational position.

To enhance operator comfort, the handle housing 18 is provided with a secondary handle 50 configured for accommodating a user's secondary hand, being associated with the second or distal end 42 and defining a distal extremity of the tool offsetting the power source 14. In the preferred embodiment, the secondary handle 50 has a first end 52 connected to the nosepiece end 46 of the battery housing 44, and a second end 54 connected to a support strut 56. It will be seen that the secondary handle 50 is connected to the tool 10 by the support strut 56 independently of any connections to the magazine 22. Also, the secondary handle 50 is located between the battery housing 44 and the magazine 22, and is a distinct portion of the handle housing 18 relative to the battery housing 44. As seen in FIGS. 1 and 2, the secondary handle 50 is also distinct from the magazine 22.

In addition, the second end 54 preferably provides a mounting point 58 for the magazine 22. The support strut 56 extends generally from the magazine mounting point 58 toward the power source 14, and more specifically is joined to the fuel cell chamber 40. It is contemplated that the mounting point 58 may be located elsewhere on the secondary handle 50 depending on the application. In the preferred embodiment, the primary handle 34, the secondary handle 50, the battery housing 44, the fuel cell chamber 40 and the support strut 56 are integrally formed in each half of the handle housing 18 by injection molding or similar production process, however it is contemplated that the components may be separately formed and joined together using fastener technologies such as screws, rivets, adhesives, ultrasonic welding or the like.

Referring now to FIG. 2, it will be seen that the mounting point 58 is the primary mount for the magazine 22 to the tool 10. As described above, the engagement of the forward end 24 of the magazine 22 with the nosepiece assembly 20 is a sliding one to facilitate fastener feeding and to prevent jamming. Thus, especially with the coil-type magazine 22 holding as many as 150 fasteners, the significant weight of this component requires a stable and positive mounting arrangement with the tool 10. The secondary handle 50 addresses this requirement with the mounting point 58.

More specifically, the magazine 22 has a wedge-shaped mounting tab 60, and the secondary handle 50 defines a wedge-shaped chamber 62 dimensioned for capturing the tab. A central aperture 64 on the tab 60 engages a fastener boss 66 in the chamber 62, and a fastener (not shown) passing through the aperture secures the respective housing halves together and the tab 60 in the chamber 62. Once the halves of the handle housing 18 join around the tab 60 as shown in FIG. 1, the tab is closely supported on at least four sides as well as being secured by the fastener and is prevented from significant movement relative to the secondary handle 50.

Another feature of the secondary handle 50 is that it is configured for receiving a thermister diagrammatically represented at 68 as a circuit board which is electrically connected to a central processing unit or CPU 70 (shown hidden in FIG. 1). As is well known in such tools, the CPU 70, preferably located in the primary handle 34, controls the operational cycle of the tool, including, among other things, the injection of Another feature of the secondary handle 50 is that it is configured for receiving a thermister diagrammatically represented at 68 as a circuit board which is electrically connected to a central processing unit or CPU 70 (shown hidden in FIG. 1). As is well known in such tools, the CPU 70, preferably located in the primary handle 34, controls the operational cycle of the tool, including, among other things, the injection of the fuel into the combustion chamber when electronic fuel injection is provided, the operation of the fan inside the combustion chamber and ignition of the combustible mixture inside the combustion chamber. It is contemplated that the CPU 70 is programmable to receive temperature data from the thermistor 68 and adjust operation of the tool 10 accordingly. An advantage of placing the thermistor 68 in the secondary handle 50 is that the thermistor is located as distally as possible from the power source 14, and as such provides a usable indicator of ambient temperature which is outside the temperature influence generated by the relatively hot power source 14 during typical tool operation.

A raceway 72 is formed in the handle housing 18 connecting a chamber 74 in the secondary handle 50 for retaining the thermistor 68 and a chamber 76 in the primary handle 34 retaining the CPU 70 to provide a place for the wiring from the thermistor to the CPU. The raceway 72, as well as the chamber 76, are configured to accommodate CPUs designed for either electronic or mechanical fuel injection. Also, the placement of the magazine mounting point 58 between the thermistor 68 and the power source 14 and relatively closer to the power source affords additional thermal insulation of the thermistor from the power source.

Figure 3:
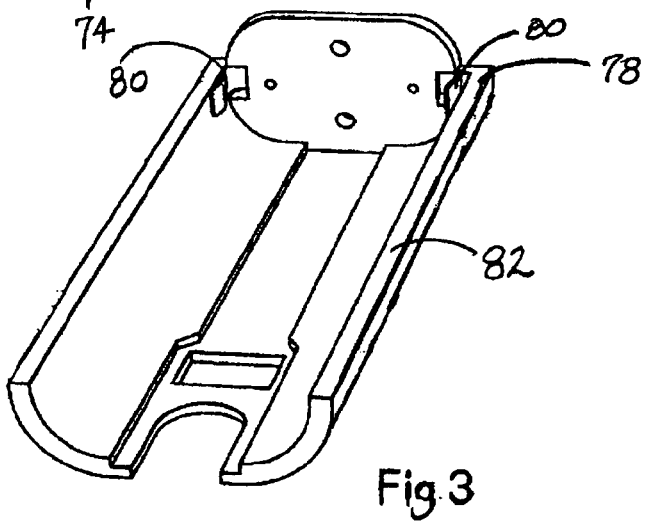
FIG. 3 is a perspective view of a battery tray configured for use with the present handle housing.

Referring now to FIGS. 2 and 3, it has been found that manufacturing of the handle housing 18 is facilitated if the battery housing 44 includes a separate battery tray 78 insertable in the battery housing and provided with at least one contact 80. The battery tray 78 contacts 80 are metallic and are constructed and arranged to engage similar contact terminals (not shown) on the battery 49 (FIG. 2). A main body 82 of the battery tray 78 is configured for receiving the battery 49, and the tray is positioned inside the housing 44 once the two halves of the handle housing 18 are joined. In this manner, separate fasteners are not needed for retaining the battery tray in place.

Figure 4:
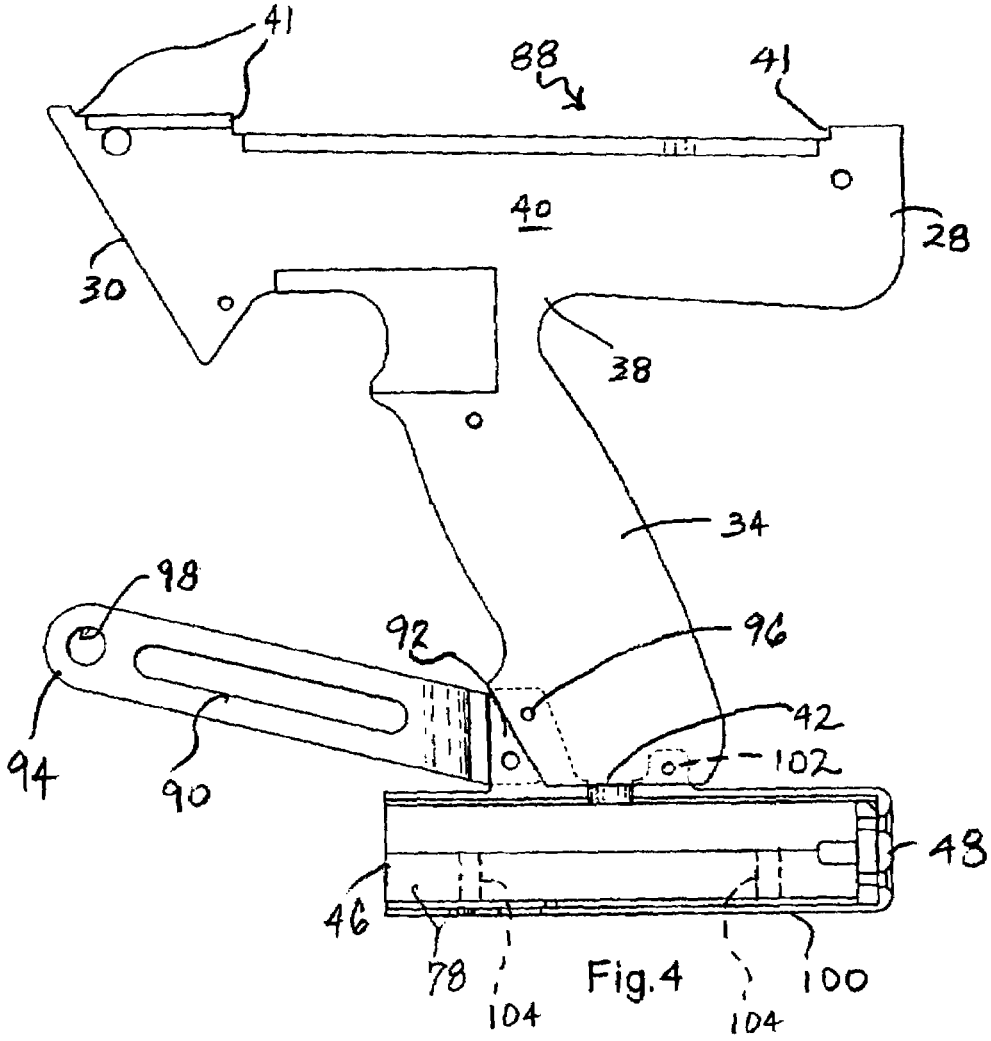
FIG. 4 is a fragmentary side elevation of an alternate embodiment of the present handle housing.

Referring now to FIG. 4, an alternate embodiment of the handle housing 18 is generally designated 88. Shared components of the two housings have been designated with identical reference numbers. A main distinction between the handle housings 18 and 88 is that in the latter, instead of the integrally formed secondary handle 50 with its support strut 56, a separate secondary handle bracket 90 is provided, having a handle end 92 and an opposite magazine end 94. The bracket 90 is made of a stiff material such as metal or durable plastic, and is fastened to the second or distal end 42 of the primary handle 34 through a corresponding eyelet 96. Upon assembly, the handle end 92 of the bracket 90 is captured between the joined halves of the handle housing 88.

At the magazine end 94, a magazine eyelet 98 is used to fasten the bracket 90 to the magazine mounting tab 60. Thus, the bracket 90 directly connects the primary handle 34 to the magazine 22. As is well known in the art, the fasteners used in attaching the bracket 90 to the tool 10 are preferably threaded fasteners however other types known in the art are contemplated. The bracket 90 forms the secondary handle, and as such provides a place for the user to place the subordinate hand not controlling the tool operation through the trigger switch 36. In the housing 88, it will also be seen that a battery housing 100 is connected to the distal end 42 as is the housing 44, but has both of the nosepiece end 46 and the combustion end 48 free of any connection to other components. As is the case with the handle end 92, the battery housing 100 is captured upon assembly at a battery housing eyelet 102 between the halves of the handle housing 88. The battery tray 78 is positioned within the battery housing 100 and is preferably provided with at least one and preferably four standoffs or legs 104 (shown hidden) for achieving proper positioning.

Thus, the handle housings 18, 88 provide improved tool balance, as well as secure mounting arrangements for high capacity coil-type magazines. The primary handle 34, as well as the battery housings 44, 100 are positioned for improved balance, especially when the tool is used for constructing walls. In addition, structure is provided for storing and connecting a thermistor for measuring ambient temperatures.

While a particular embodiment of the present primary and secondary handles for a power tool have been described herein, it will be appreciated by those skilled in the art that changes and modifications may be made thereto without departing from the invention in its broader aspects and as set forth in the following claims.

The invention claimed is:

1. A housing for a power tool having a nosepiece end and a combustion end, comprising:

a primary handle configured for accommodating a primary hand used to control the operation of the tool, said handle having a first end closer to a power source of the tool, and a second end distal of the power source;

a secondary handle configured for accommodating a secondary hand, being associated with said distal end and defining a distal extremity of the tool offsetting the power source; wherein said primary handle is closer to the nosepiece end than to the combustion end for improving balance of the tool;

a magazine, said secondary handle providing a mounting point for the magazine; and a support strut extending from said magazine mounting point toward said power source.

2. The housing of claim 1 wherein said secondary handle has a first end associated with said primary handle, and a second end is connected to the tool at the power source independent of the connection of the magazine to the tool.

3. The housing of claim 1 wherein said mounting point is the primary mount for said magazine to the tool.

4. The housing of claim 1 wherein the magazine has a wedge-shaped mounting tab, and said secondary handle defines a wedge-shaped chamber dimensioned for capturing said tab.

5. The housing of claim 4 further including a fastener boss in said chamber for receiving a securing fastener engaging said boss and the magazine mounting tab.

6. The housing of claim 1 further including a fuel cell chamber connectable to said power source and receiving said first end of said primary handle and said support strut.

7. The housing of claim 1 further including a fuel chamber connectable to said power source and being fixed to said first end of said primary handle.

8. The housing of claim 1 further including a battery housing associated with said distal end of said primary handle, one end of said secondary handle being connected to said housing adjacent an end of said battery housing.

9. The housing of claim 8 wherein said battery housing includes a separate battery tray insertable in said battery housing and being provided with at least one contact.

10. The housing of claim 1 wherein the tool includes a battery housing, and said secondary handle is interposed between the magazine and said battery housing.

11. The housing of claim 1 wherein said secondary handle is configured for retaining a thermistor in a location distal from the power source.

12. The housing of claim 11 further including a magazine mount on said secondary handle closer to the power source than a chamber for retaining said thermistor.

13. The housing of claim 11 further including a raceway in said primary handle for receiving wiring connecting a chamber for receiving said thermistor and a chamber defined by said primary handle.

14. The housing of claim 1 wherein said secondary handle is independent of a battery housing and said magazine for the tool.

15. The housing of claim 1 wherein said secondary handle is a bracket configured for securing said primary handle to said magazine.

16. A housing for a power tool having a nosepiece end and a combustion end, comprising:

a primary handle configured for accommodating a primary hand used to control the operation of the tool, said handle having a first end closer to a power source of the tool, and a second end distal of the power source;

a secondary handle configured for accommodating a secondary hand, being associated with said distal end and defining a distal extremity of the tool offsetting the power source; wherein said primary handle is closer to the nosepiece end than to the combustion end;

a battery housing associated with said distal end of said primary handle, one end of said secondary handle being connected to said battery housing adjacent an end of said battery housing, said battery housing disposed relative to said secondary handle for receiving a battery arranged generally parallel to said power source for improving balance of the tool;

a magazine, said secondary handle providing a mounting point for the magazine;

a support strut extending from said magazine mounting point toward said power source; and a fuel cell chamber connectable to said power source and receiving said first end of said primary handle and said support strut.

* * * * *